US011149374B2

(12) United States Patent
Holzen et al.

(10) Patent No.: US 11,149,374 B2
(45) Date of Patent: Oct. 19, 2021

(54) VENTED GASKET FOR WASHING MACHINE APPLIANCE

(71) Applicant: Haier US Appliance Solutions, Inc., Wilmington, DE (US)

(72) Inventors: Thomas Holzen, Louisville, KY (US); Stephen Neil Malone, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 259 days.

(21) Appl. No.: 16/268,704

(22) Filed: Feb. 6, 2019

(65) Prior Publication Data

US 2020/0248372 A1 Aug. 6, 2020

(51) Int. Cl.
*D06F 37/26* (2006.01)
*D06F 23/02* (2006.01)

(52) U.S. Cl.
CPC ..... *D06F 37/266* (2013.01); *D06F 23/02* (2013.01)

(58) Field of Classification Search
CPC ..... D06F 37/266; D06F 23/02
See application file for complete search history.

(56) References Cited

U.S. PATENT DOCUMENTS

| | | | | |
|---|---|---|---|---|
| 7,516,630 | B2 * | 4/2009 | Kim | B05B 1/267 68/183 |
| 7,810,360 | B2 | 10/2010 | Kim et al. | |
| 7,934,280 | B2 | 5/2011 | Kim et al. | |
| 9,260,812 | B2 * | 2/2016 | Moon | D06F 37/22 |
| 9,732,459 | B2 * | 8/2017 | Kim | D06F 37/266 |
| 2004/0163426 | A1 * | 8/2004 | Kim | D06F 39/14 68/23 A |
| 2005/0262879 | A1 * | 12/2005 | Kim | D06F 37/266 68/3 R |
| 2011/0083477 | A1 * | 4/2011 | Kim | D06F 37/266 68/140 |
| 2011/0139190 | A1 | 6/2011 | Northrup | |

FOREIGN PATENT DOCUMENTS

| | | | |
|---|---|---|---|
| EP | 2684992 | A1 | 1/2014 |
| KR | 100605732 | B1 | 8/2006 |
| WO | WO2009083396 | A1 | 7/2009 |

* cited by examiner

*Primary Examiner* — Benjamin L Osterhout
(74) *Attorney, Agent, or Firm* — Dority & Manning, P.A.

(57) ABSTRACT

A door gasket for a washing machine appliance includes a front ring engaging a front panel of the cabinet and extending around an opening defined by the front panel. A web extends from the front ring toward the wash tub and includes a flexing region (e.g., an S-fold) at least partially defining a trough. A back ring engages the wash tub and defines a plurality of venting apertures that provide fluid communication between the trough and the wash tub.

20 Claims, 6 Drawing Sheets

VENTED GASKET FOR WASHING MACHINE APPLIANCE

FIELD OF THE INVENTION

The present subject matter relates generally to gaskets for washing machine appliances, or more specifically, to gaskets for front load washing machine appliances with improved venting.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

Conventional front load washing machine appliance include a tub that is horizontally positioned within the cabinet and is accessible through an opening defined in a front panel of the cabinet. A door and gasket assembly provide selective access to the tub while preventing wash fluid from pouring through or otherwise sloshing from the wash tub through the opening during operation. Notably, to facilitate some movement between the cabinet and the wash tub, the gasket may include folds, crevices, or other areas which might not easily drain back into the tub. As a result, residual moisture within the gasket between cycles may result in a musty or moldy smell which is undesirable for the consumer.

Accordingly, a washing machine appliance having an improved gasket would be desirable. More particularly, a gasket for a front load washing machine appliance which includes features for improved draining and for air drying the gasket would be particularly beneficial.

BRIEF DESCRIPTION OF THE INVENTION

Advantages of the invention will be set forth in part in the following description, or may be apparent from the description, or may be learned through practice of the invention.

In accordance with one exemplary embodiment of the present disclosure, a washing machine appliance is provided including a cabinet including a front panel defining an opening, a wash tub positioned within the cabinet, and a wash basket rotatably mounted within the wash tub and defining a wash chamber for receiving a load of articles for washing. A door is rotatably mounted to the cabinet for providing selective access to the wash chamber through the opening and a gasket extends around the opening and extends from the wash tub for sealing against the door when the door is in a closed position. The gasket includes a front ring engaging the front panel of the cabinet, a web extending from the front ring toward the wash tub, the web comprising a flexing region at least partially defining a trough, and a back ring engaging the wash tub, the back ring defining a plurality of venting apertures that provide fluid communication between the trough and the wash tub.

In accordance with another exemplary embodiment of the present disclosure, a door gasket for a washing machine appliance is provided. The washing machine appliance includes a cabinet having a front panel defining an opening, a wash tub positioned within the cabinet, and a door rotatably mounted to the cabinet. The door gasket includes a front ring engaging the front panel of the cabinet and extending around the opening, a web extending from the front ring toward the wash tub, the web comprising a flexing region at least partially defining a trough, and a back ring engaging the wash tub, the back ring defining a plurality of venting apertures that provide fluid communication between the trough and the wash tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
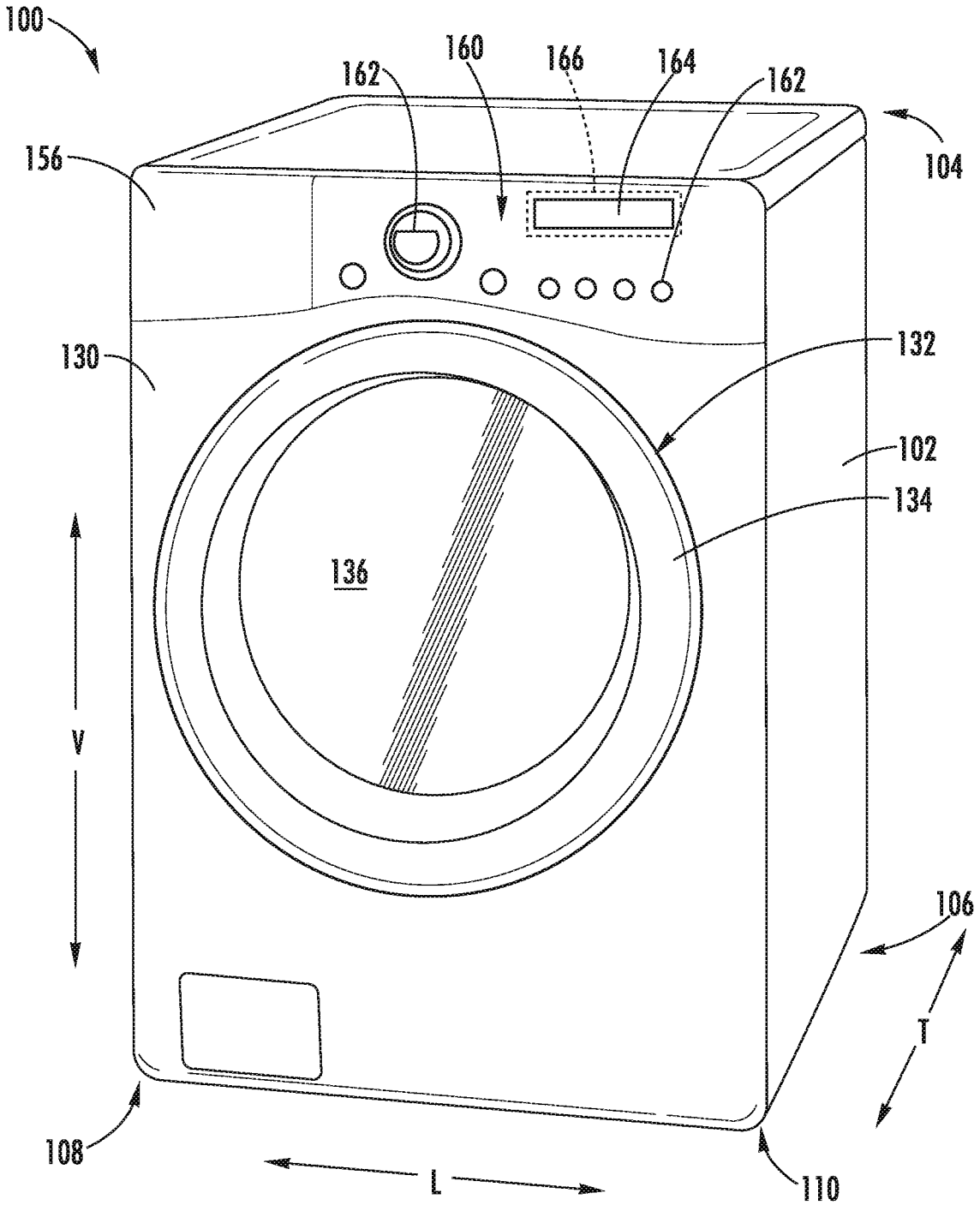
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "upstream" and "downstream" refer to the relative direction with respect to fluid flow in a fluid pathway. For example, "upstream" refers to the direction from which the fluid flows, and "downstream" refers to the direction to which the fluid flows. Furthermore, as used herein, terms of approximation, such as "approximately," "substantially," or "about," refer to being within a ten percent margin of error.

Figure 2:
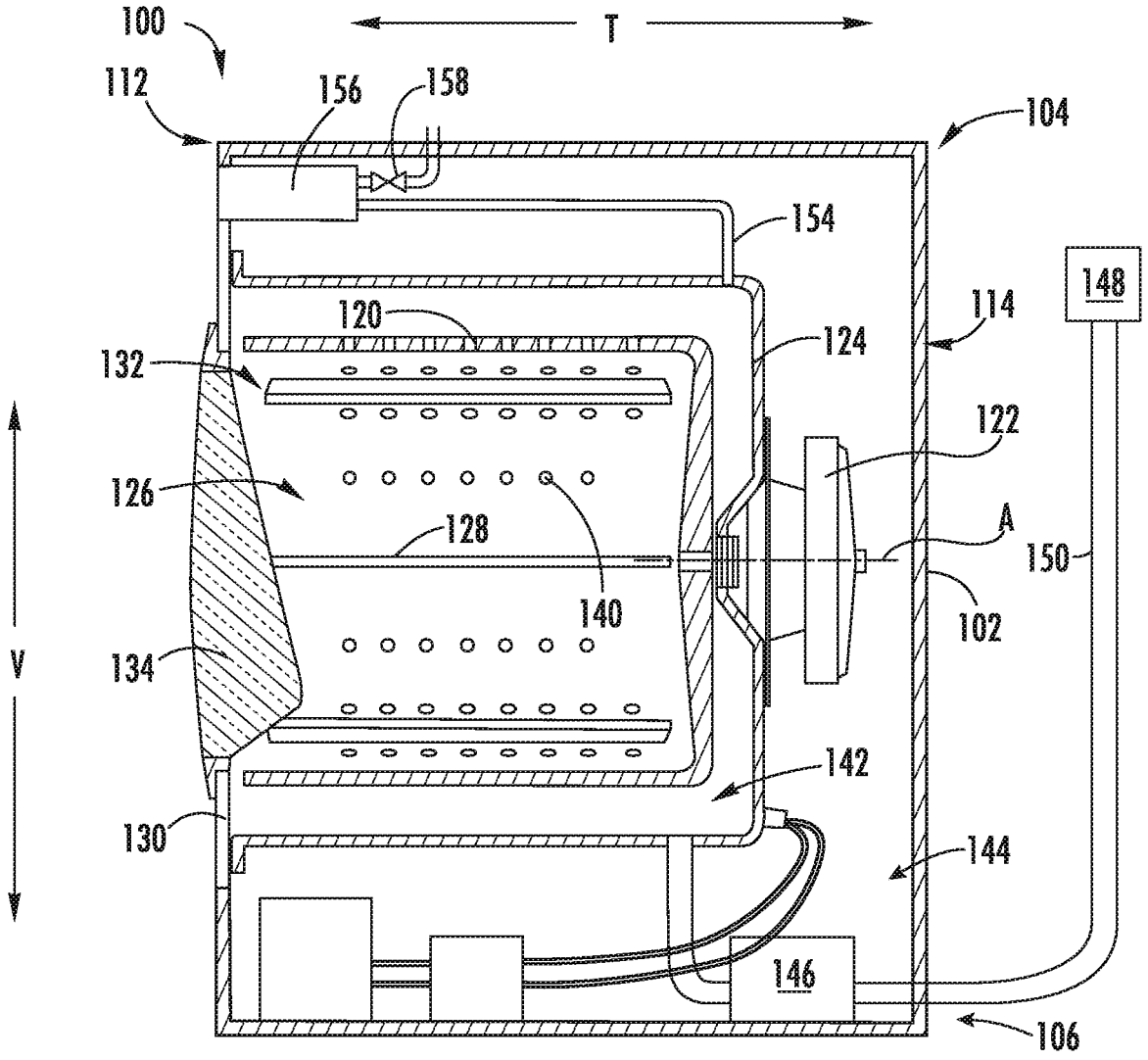
FIG. 2 provides a side cross-sectional view of the exemplary washing machine appliance of FIG. 1.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash chamber 126 of wash basket 120. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash chamber 126 and a closed position (FIG. 1) prohibiting access to wash chamber 126.

A window 136 in door 134 permits viewing of wash chamber 126 when door 134 is in the closed position, e.g., during operation of washing machine appliance 100. Door 134 also includes a handle (not shown) that, e.g., a user may pull or push when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor which is energized during a drain cycle such that drain pump 146 draws wash fluid from sump 142 and urges it through drain hose 150 to external drain 148.

A spout 154 is configured for directing a flow of fluid into wash tub 124. For example, spout 154 may be in fluid communication with a water supply (not shown) in order to direct fluid (e.g., clean water) into wash tub 124. Spout 154 may also be in fluid communication with the sump 142. For example, pump assembly 144 may direct wash fluid disposed in sump 142 to spout 154 in order to circulate wash fluid in wash tub 124.

As illustrated in FIG. 2, a detergent dispenser 156 may be slidably mounted within front panel 130. Detergent dispenser 156 receives a wash additive (e.g., detergent, fabric softener, bleach, or any other suitable liquid or powder) and directs the fluid additive to wash tub 124 during operation of washing machine appliance 100. According to the illustrated embodiment, detergent dispenser 156 may also be fluidly coupled to spout 154 to facilitate the complete and accurate dispensing of wash additive.

In addition, a water supply valve 158 may provide a flow of water from a water supply source (such as a municipal water supply) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 154 and or detergent dispenser 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in wash basket 120 are cleaned and/or washed, the user can remove the articles from wash basket 120, e.g., by opening door 134 and reaching into wash basket 120 through opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

Referring now generally to FIGS. 3 through 8, a door gasket 200 which may be used with washing machine appliance 100 will be described according to an exemplary embodiment of the present subject matter. As explained above, front panel 130 of washing machine appliance 100 defines an opening 132 through which a user may access wash chamber 126. However, when wash tub 124 is filled with wash fluid, e.g., during an operating cycle, such wash fluid may have a tendency to flow or spill out of wash tub 124 through opening 132. Thus, door gasket 200 is generally configured for providing a fluid seal between wash tub 124 and door 134. Although an exemplary construction of door gasket 200 is described below and illustrated in the figures, it should be appreciated that variations and modifications may be made to such door gasket 200 while remaining within the scope of the present subject matter.

Figure 3:
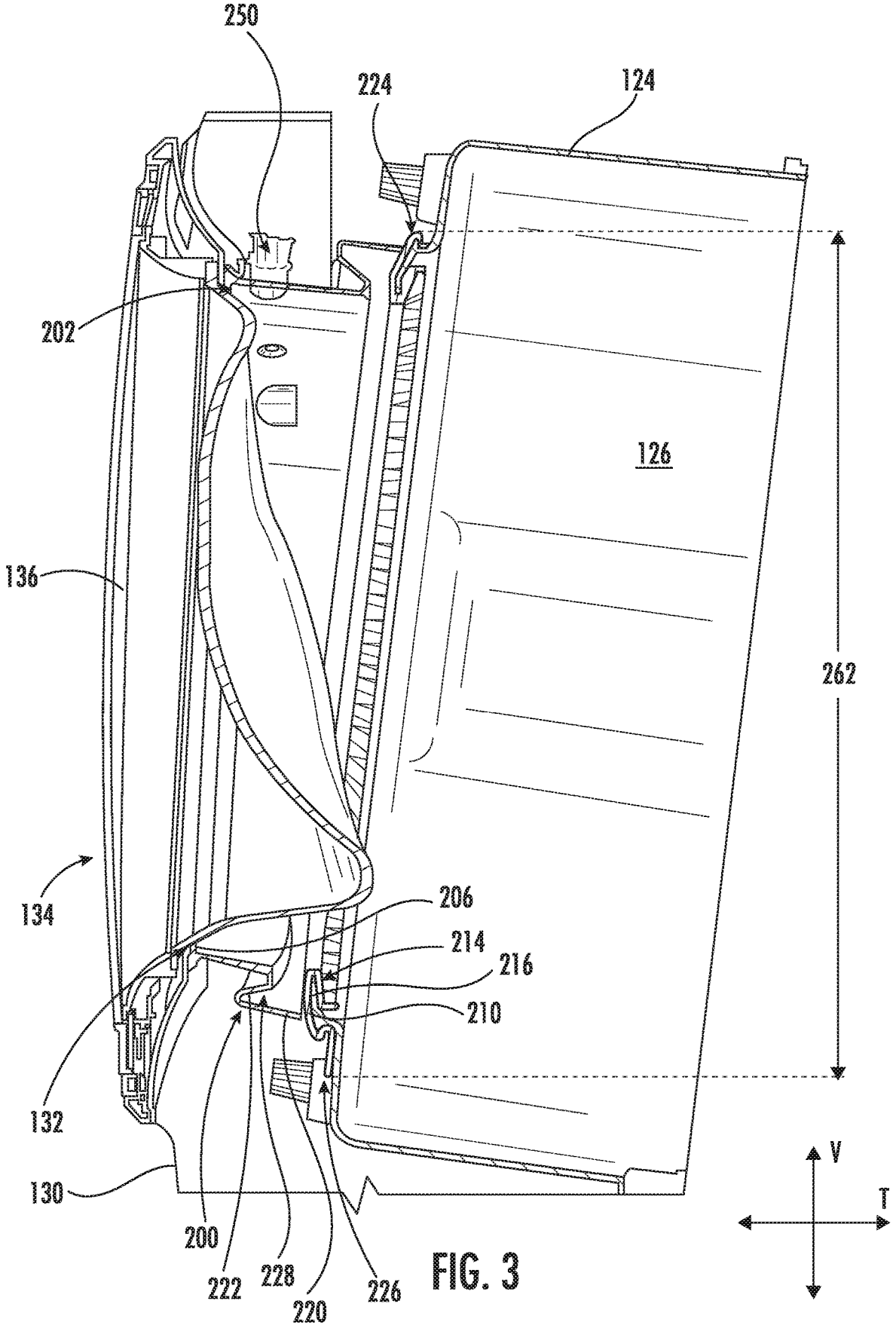
FIG. 3 provides a cross sectional view of a wash tub and a door of the exemplary washing machine appliance of FIG. 1 according to an exemplary embodiment of the present subject matter.
Figure 4:
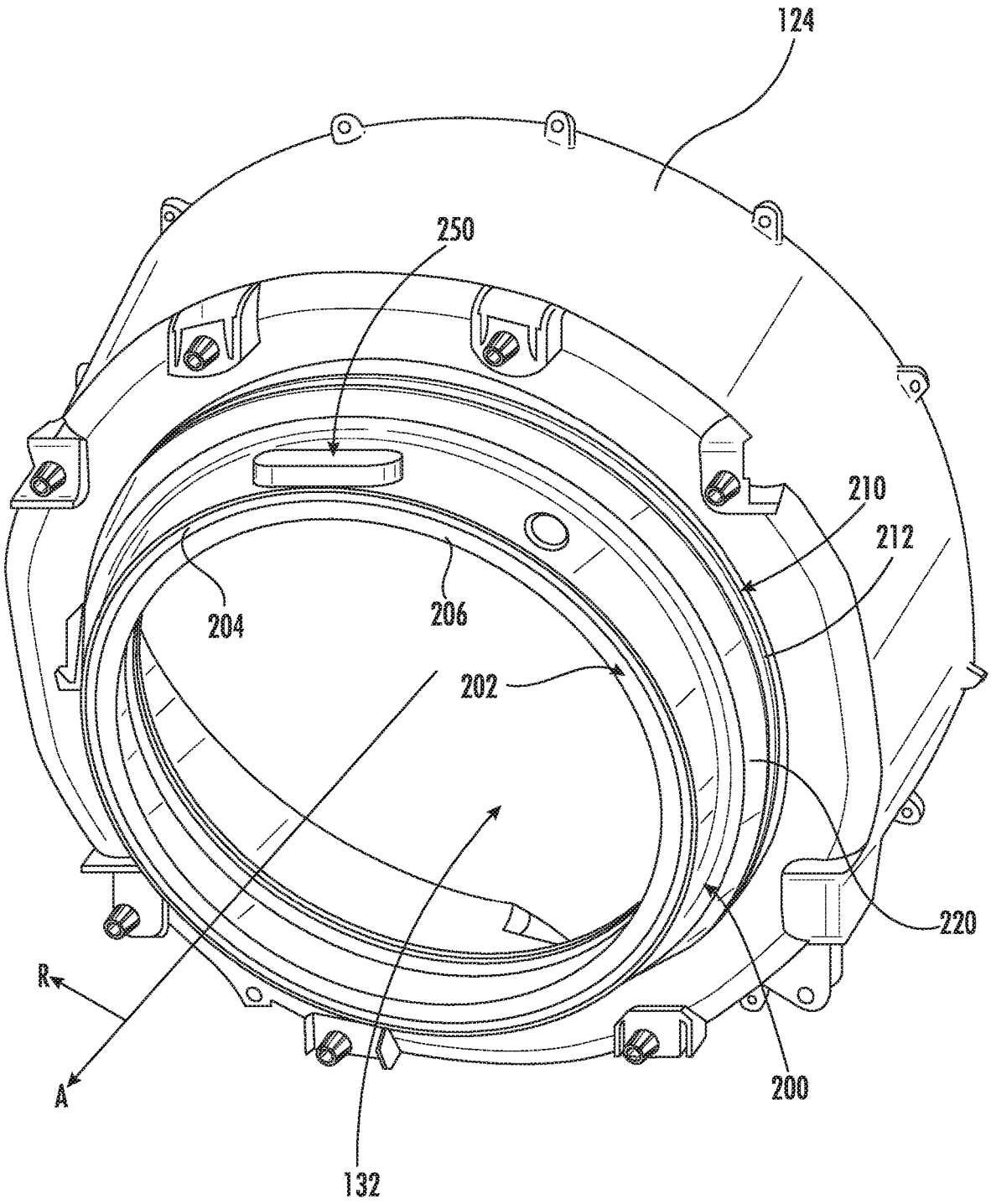
FIG. 4 provides a perspective view of a gasket and a wash tub of the exemplary washing machine appliance of FIG. 1 according to an embodiment of the present subject matter.

As best shown in FIGS. 3 and 4, door gasket 200 extends around opening 132 and is joined with or sealed against wash tub 124, front panel 130, and door 134 when in the closed position. Specifically, as shown, door gasket 200 includes a front ring 202 which engages front panel 130 of cabinet 102. In this regard, front ring 202 may be a substantially circular member which includes a front flange 204 for securely seating on front panel 130 around opening 132. In this regard, front flange 204 should be securely received on front panel 130 such that door gasket 200 remains seated on front panel 130 regardless of movement of washing machine appliance 100 or wash tub 124. Furthermore, front ring 202 may define an engaging lip 206 (e.g., best shown in FIG. 8) which extends inward along a radial direction R for engaging door 134 when in the closed position.

Figure 7:
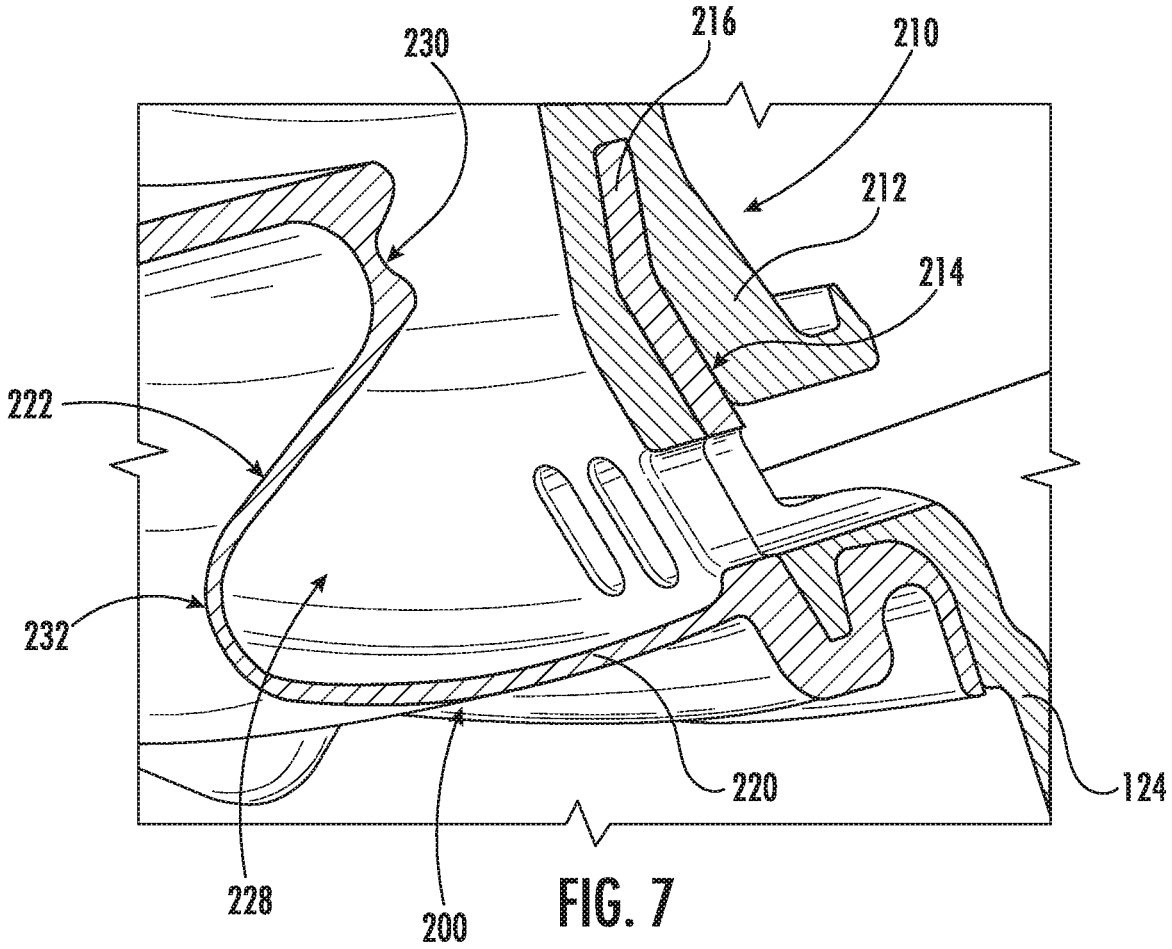
FIG. 7 provides a perspective, cross sectional view of the exemplary door and gasket of FIG. 3 according to an embodiment of the present subject matter.
Figure 8:
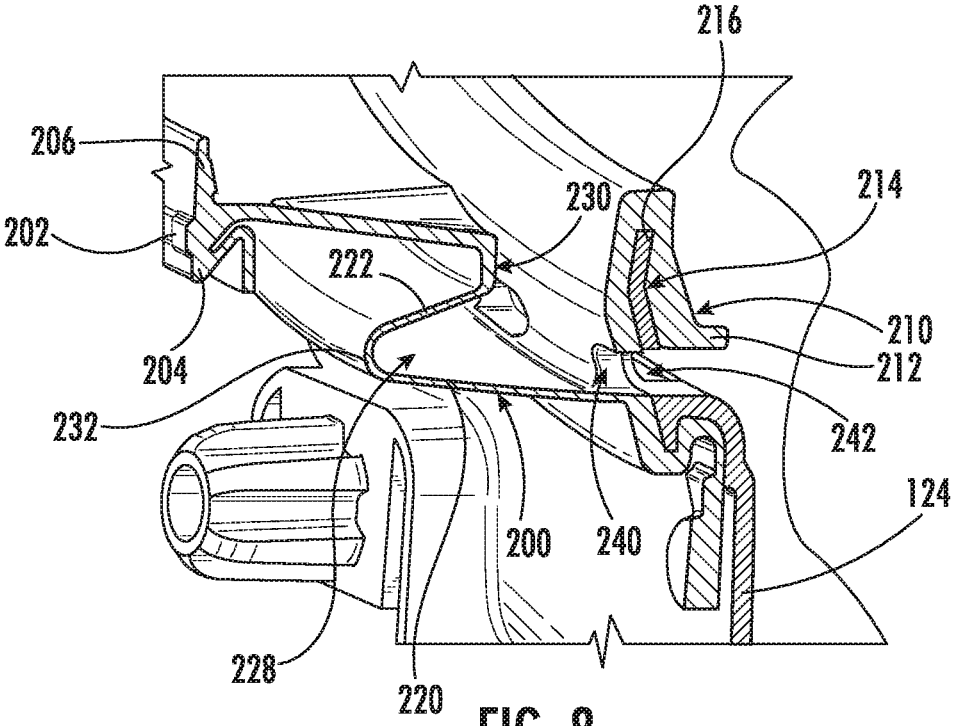
FIG. 8 provides a perspective, cross sectional view of the exemplary door assembly and gasket of FIG. 3 according to an embodiment of the present subject matter.

Door gasket 200 further includes a back ring 210 for engaging wash tub 124. As best shown in FIGS. 7 and 8, similar to front ring 202, back ring 210 is a substantially circular member which includes a back flange 212 that defines a slot 214 for receiving a front flange 216 of wash tub 124. In this manner, back ring 210 may be securely received by front flange 216 to provide a fluid tight engagement between wash tub 124 and door gasket 200.

Door gasket 200 may further include a web 220 which extends between front ring 202 and back ring 210. In this regard, web 220 generally includes some slack or excess material to permit movement between wash tub 124 and front panel 130 while maintaining a fluid seal between wash tub 124, door gasket 200, and door 134. In this regard, wash tub 124, or the subwasher more generally which is supported by a suspension, may move within cabinet 102 without affecting the seal created by door gasket 200.

Specifically, web 220 of door gasket 200 may include at least one folded portion or segment of gasket 220 which includes a substantially excess amount of material which permits wash tub 124 movement, referred to herein as a S-fold 222. For example, S-fold 222 is so named because a cross-section of web 220 resembles an "S" at a top 224 of door gasket 220 and an inverse "S" at a bottom 226 of door gasket 220. In this regard, web extends from front panel 130 toward wash tub 124 substantially along the transverse direction T before folding (e.g., at first fold 230) back toward the front panel 130 and outward along a radial direction R (FIG. 4) defined by door 134 (e.g., away from axis of rotation A), before folding (e.g., at second fold 232) back toward wash tub 124 and back ring 210.

Although the region of door gasket 220 including excess material is referred to herein as an S-fold 222, it should be appreciated that this section of door gasket 220 may have any other suitable size, geometry, and configuration suitable for permitting movement of the subwasher or wash tub 124 within cabinet 102. For example, a cross section of door gasket 220 may define a length that is greater than two times, three times, or more than a length of gasket that extends in a straight line between front flange 204 and back flange 212. This region of excess material in door gasket 220 may be referred to herein as the "flexing region" of door gasket 220, illustrated as S-fold 222 according to an exemplary embodiment.

As illustrated, a trough 228 may be defined proximate second fold 232 of web 220. Although trough 228 is desirable to facilitate movement between wash tub 124 and cabinet 102, it also has a tendency to collect wash fluid, lint, and other residue from the operating cycles of washing machine appliance 100. Thus, aspects of the present subject matter are directed towards means for ensuring airflow through trough 228 and door gasket 200 to reduce the containment or buildup of such residue and moisture which may result in a multi- or mildew smell.

Figure 6:
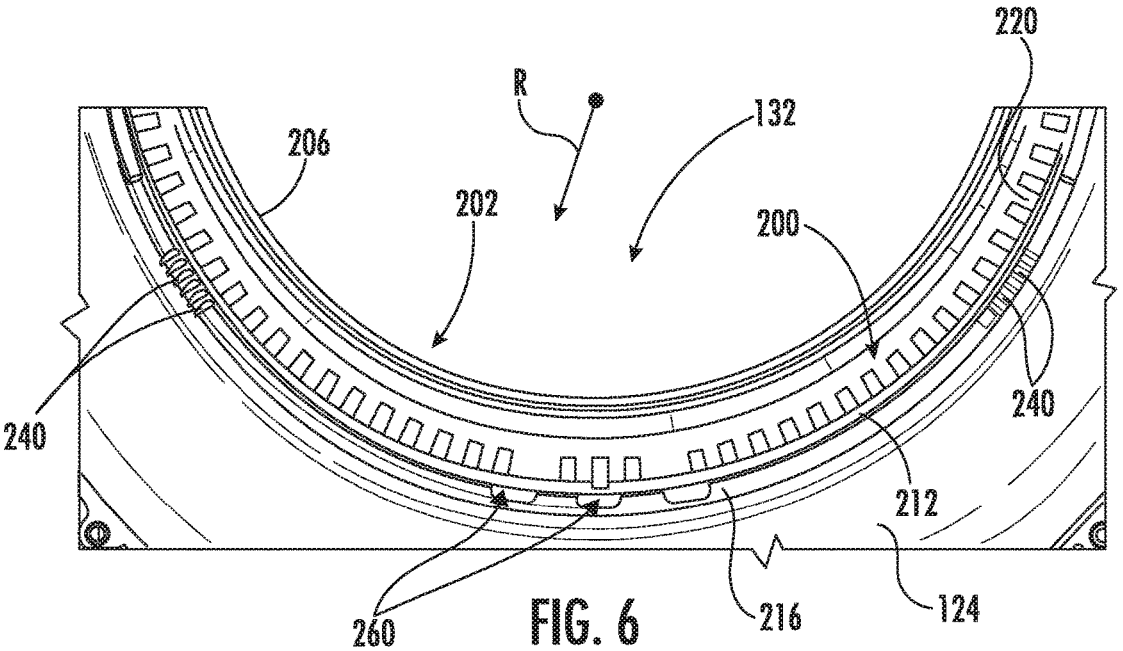
FIG. 6 provides a rear view of the wash tub and the exemplary gasket according to one embodiment of the present subject matter.

Specifically, as best illustrated in FIGS. 6 through 8, back ring 210 of door gasket 200 may define a plurality of venting apertures 240 that provide fluid communication between trough 228 and wash tub 124. Specifically, for example, venting apertures 240 may be defined proximate a middle of back ring 210 along the radial direction R, or at any other suitable location on back ring 210 or back flange 212. In addition, according to an exemplary embodiment, a wash tub 124 may further define tub apertures 242 which correspond with and align with venting apertures 240 when door gasket 200 is properly installed on front flange 216 of wash tub 124. In this regard, venting apertures 240 and tub apertures 242 extend from trough 228 through and into wash tub 124 to permit the flow of air to pass through door gasket 200 (e.g., around and over web 220) into wash tub 124 and/or to the external environment to facilitate drying of door gasket 200.

Figure 5:
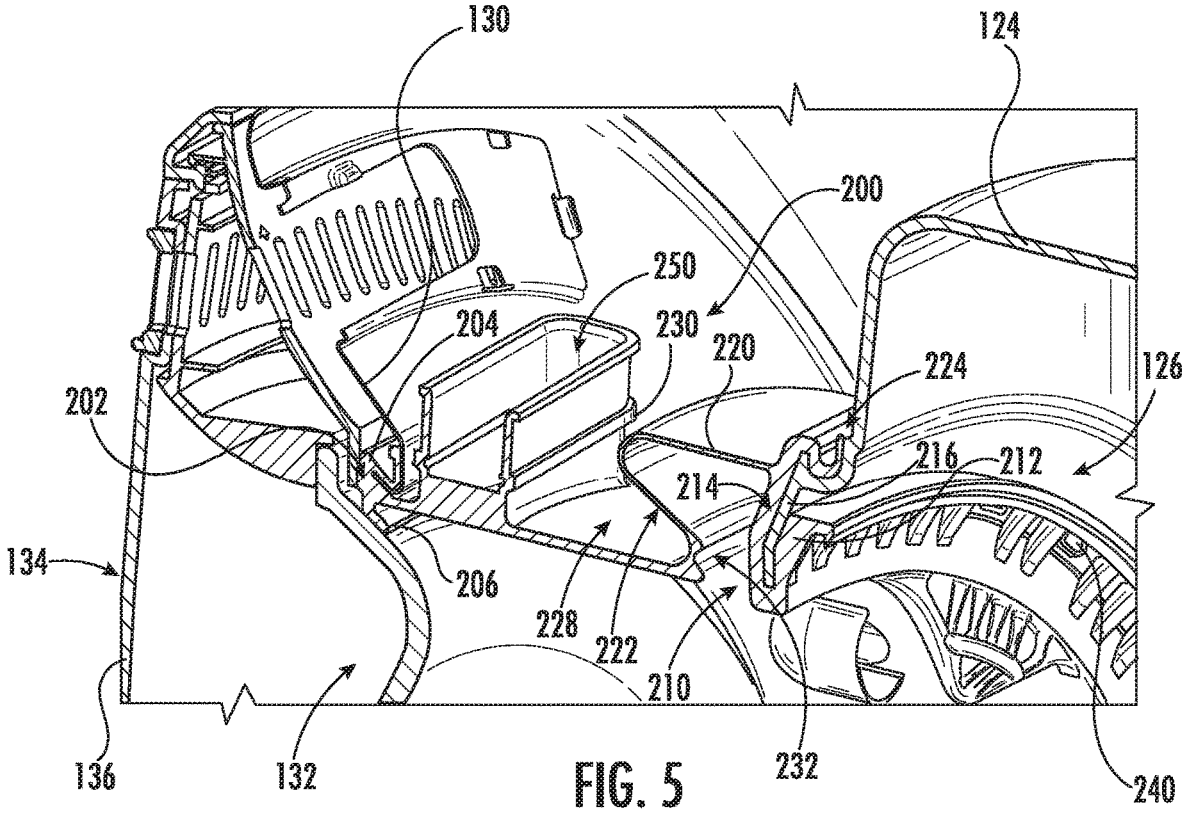
FIG. 5 provides a perspective, cross sectional view of the exemplary door, gasket, and wash tub according to an embodiment of the present subject matter.

Referring now specifically to FIGS. 3 through 5, door gasket 200 may further include a fresh air intake port 250 which is positioned at a top 224 of door gasket 200 along the vertical direction V. Specifically, fresh air intake port 250 is defined by web 220 and permits fluid communication between an external environment and trough 228. In this manner, the flow of fresh air may enter from an external environment into door gasket 200 and wash tub 124, and vice versa.

According to exemplary embodiments the present subject matter, venting apertures 240 and tub apertures 242 may have any suitable size, shape, position, and distribution as desired to facilitate the drying of door gasket 200. For example, according to an exemplary embodiment, venting apertures 240 are spaced equidistantly about the entire circumference of back ring 210. In this regard, for example, venting apertures 240 may include more than five apertures, more than 10 apertures, more than 20 apertures, more than 50 apertures, or more. In addition, according to exemplary embodiments, the circumferential spacing between such venting apertures 240 may be identical or may vary as needed to facilitate the flow of air through door gasket 200.

Notably, back ring 210 of door gasket 200 may further define drain holes 260 (FIG. 6) which are positioned at the bottom 226 of door gasket 200 along the vertical direction V. Notably, drain holes 260 are distinct from venting apertures 240 in their size, position, and intended function. In this regard, drain holes 260 are positioned only at bottom 226 of door gasket 200 to facilitate draining of wash fluid into wash tub 124, i.e., under the force of gravity. By contrast, venting apertures 240 may be positioned above drain holes 260 along the vertical direction V and are sized, shaped, and positioned for facilitating the flow of air as opposed to simply the flow of wash fluid.

For example, according to an exemplary embodiment, door gasket 200, or more specifically back ring 210 of door gasket 200, may define a height 262 along the vertical direction V when properly installed. In this regard, height 262 corresponds substantially with the diameter of opening 132 or the distance between top 224 and bottom 226 of door gasket 200. According to one embodiment, at least one of venting apertures is positioned above the bottom quarter of height 262 of back ring 210 along the vertical direction V. According to still another embodiment, and apertures 240 may be positioned in a top half of height 262 or at a very top 224 of door gasket 200.

In addition, venting apertures 240 and drain holes 260 may have different cross-sectional shapes. In this regard, venting apertures may be an elongated slot that extends along the radial direction. By contrast, drain holes 260 may be a slot that extends along or is curved along the circumferential direction along back ring 210. In addition, venting apertures 240 may be smaller than drain holes 260 and may be placed inward from drain holes 260 along the radial direction R.

In addition, drain holes 260 are positioned only at the bottom 226 of door gasket 200 and have a cross-sectional area sufficient only to permit water collected at bottom 226 of door gasket 200 to drain under the force of gravity back into wash tub 124. By contrast, the total cross-sectional area of venting apertures 240 may be much larger than that of drain holes 260 in order to facilitate more airflow through door gasket 200. Specifically, for example, back ring 210 may define a contact area where an outer surface of front flange 216 engages back ring 210. In addition, venting apertures 240 may define a collective area which is equivalent to the sum of all venting apertures 240. A void ratio may be defined as the collective area of venting apertures 240 over the contact area between front flange 216 and back ring 210. According to exemplary embodiments, the void ratio may be greater than 0.2, greater than 0.5, greater than 0.8, or greater. Indeed, it may be desirable to have the void ratio as large as possible without sacrificing the structural integrity of back ring 210 or front flange 216 of wash tub 124.

Although an exemplary door gasket 200 is described above, it should be appreciated that variations and modifications may be made to such door gasket while remaining within the scope of the present subject matter. For example, the size and/or spacing of venting apertures 240 may vary, the means by which back ring 210 engages wash tub 124 may be different, and other means for introducing air into the door gasket 200 or trough 228 may be used while remaining within the scope of the present subject matter. Thus, the described door gasket 200 is intended only as one exemplary embodiment for describing aspects of the present subject matter and is not intended to limit the present subject matter in any manner.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet comprising a front panel defining an opening;

a wash tub positioned within the cabinet;

a wash basket rotatably mounted within the wash tub and defining a wash chamber for receiving a load of articles for washing;

a door rotatably mounted to the cabinet for providing selective access to the wash chamber through the opening; and a gasket extending around the opening and extending from the wash tub for sealing against the door when the door is in a closed position, the gasket comprising:

a front ring engaging the front panel of the cabinet;

a web extending from the front ring toward the wash tub, the web comprising a flexing region at least partially defining a trough; and a back ring engaging the wash tub, the back ring defining a plurality of venting apertures configured to provide fluid communication between the trough and the wash tub.

2. The washing machine appliance of claim 1, wherein the wash tub defines tub apertures which correspond to the venting apertures such that the venting apertures and tub apertures extend from the trough through and into the wash tub.

3. The washing machine appliance of claim 1, wherein the venting apertures are spaced equidistantly about an entire circumference of the back ring.

4. The washing machine appliance of claim 1, wherein at least one of the venting apertures is positioned above a bottom quarter of a height of the back ring along the vertical direction, wherein the height is measured between a top and a bottom of the gasket along the vertical direction.

5. The washing machine appliance of claim 1, wherein at least one of the venting apertures is positioned in a top half of a height of the back ring along the vertical direction, wherein the height is measured between a top and a bottom of the gasket along the vertical direction.

6. The washing machine appliance of claim 1, wherein the back ring defines a contact area where the back ring engages a front flange of the wash tub, and wherein the wash tub apertures are defined in the front flange.

7. The washing machine appliance of claim 6, wherein the venting apertures define a collective area, and wherein a void ratio of the collective area over the contact area is greater than 0.2.

8. The washing machine appliance of claim 6, wherein the venting apertures define a collective area, and wherein a void ratio of the collective area over the contact area is greater than 0.5.

9. The washing machine appliance of claim 1, wherein the flexing region defines a fresh air intake port at a top of the gasket along the vertical direction, the fresh air intake port being in fluid communication with the trough.

10. The washing machine appliance of claim 1, wherein the venting apertures comprise more than 20 apertures.

11. The washing machine appliance of claim 1, wherein at least one of the venting apertures is an elongated slot.

12. The washing machine appliance of claim 11, wherein the drain holes have a different shape than the venting apertures.

13. The washing machine appliance of claim 1, wherein the back ring of the gasket further defines drain holes positioned at the bottom of the gasket along the vertical direction.

14. A door gasket for a washing machine appliance, the washing machine appliance comprising a cabinet having a front panel defining an opening, a wash tub positioned within the cabinet, and a door rotatably mounted to the cabinet, the door gasket comprising:

a front ring engaging the front panel of the cabinet and extending around the opening;

a web extending from the front ring toward the wash tub, the web comprising a flexing region at least partially defining a trough; and a back ring engaging the wash tub, the back ring defining a plurality of venting apertures configured to provide fluid communication between the trough and the wash tub.

15. The door gasket of claim 14, wherein the wash tub defines tub apertures which correspond to the venting apertures such that the venting apertures and tub apertures extend from the trough through and into the wash tub.

16. The door gasket of claim 14, wherein the venting apertures are spaced equidistantly about an entire circumference of the back ring.

17. The door gasket of claim 14, wherein at least one of the venting apertures is positioned above a bottom quarter of a height of the back ring along the vertical direction, wherein the height is measured between a top and a bottom of the gasket along the vertical direction.

18. The door gasket of claim 14, wherein at least one of the venting apertures is positioned in a top half of a height of the back ring along the vertical direction, wherein the height is measured between a top and a bottom of the gasket along the vertical direction.

19. The door gasket of claim 14, wherein the back ring defines a contact area where the back ring engages a front flange of the wash tub, and wherein the wash tub apertures are defined in the front flange, and wherein the venting apertures define a collective area, and wherein a void ratio of the collective area over the contact area is greater than 0.2.

20. The door gasket of claim 14, wherein the back ring of the door gasket further defines drain holes positioned at the bottom of the door gasket along the vertical direction.

* * * * *